US009654893B2

(12) United States Patent
Estrada et al.

(10) Patent No.: US 9,654,893 B2
(45) Date of Patent: May 16, 2017

(54) SURROUND SOUND RECORDING ARRAY

(71) Applicants: Stephen Xavier Estrada, Escondido, CA (US); Nicholas Alexander Knickerbocker, Los Angeles, CA (US)

(72) Inventors: Stephen Xavier Estrada, Escondido, CA (US); Nicholas Alexander Knickerbocker, Los Angeles, CA (US)

( * ) Notice: Subject to any disclaimer, the term of this patent is extended or adjusted under 35 U.S.C. 154(b) by 0 days.

(21) Appl. No.: 14/980,234

(22) Filed: Dec. 28, 2015

(65) Prior Publication Data

US 2016/0192102 A1 Jun. 30, 2016

Related U.S. Application Data

(60) Provisional application No. 62/098,217, filed on Dec. 30, 2014.

(51) Int. Cl.

| | |
|---|---|
| ***H04S 5/00*** | (2006.01) |
| ***H04R 1/08*** | (2006.01) |
| ***H04R 1/28*** | (2006.01) |
| ***H04R 5/027*** | (2006.01) |
| *H04R 1/02* | (2006.01) |
| *H04R 1/32* | (2006.01) |
| *H04R 1/40* | (2006.01) |
| *H04R 3/00* | (2006.01) |
| *H04S 3/00* | (2006.01) |

(52) U.S. Cl.

CPC ..... *H04S 5/005* (2013.01); *H04R 5/027* (2013.01); *H04R 1/02* (2013.01); *H04R 1/326* (2013.01); *H04R 1/406* (2013.01); *H04R 3/00* (2013.01); *H04R 2201/401* (2013.01); *H04R 2420/09* (2013.01); *H04S 3/008* (2013.01); *H04S 2400/15* (2013.01)

(58) Field of Classification Search

CPC ... H04R 1/02; H04R 1/08; H04R 1/20; H04R 1/22; H04R 1/222; H04R 1/24; H04R 1/245; H04R 1/26; H04R 1/265; H04R 1/32; H04R 1/326; H04R 1/40; H04R 1/406; H04R 3/00; H04R 5/027; H04R 29/005; H04R 2201/401; H04R 2201/02; H04R 2201/025; H04R 2201/405; H04R 2420/09; H04R 2430/20; G10K 11/008; H04S 3/00; H04S 3/008; H04S 5/00; H04S 5/005; H04S 2400/15; H04S 2420/01

See application file for complete search history.

(56) References Cited

U.S. PATENT DOCUMENTS 3,141,148 A * 7/1964 Hueter ..... G10K 11/008 367/153
3,160,847 A * 12/1964 Beck ..... G10K 11/008 248/694
3,736,557 A * 5/1973 Brynk ..... G01S 3/802 367/120
3,886,491 A * 5/1975 Jonkey ..... G10K 11/008 367/153
4,323,988 A * 4/1982 Will ..... G01S 15/00 367/153

(Continued)

*Primary Examiner* — Mark Fischer
(74) *Attorney, Agent, or Firm* — Wagenknecht IP Law Group PC

(57) ABSTRACT

Provided herein is a multichannel sound recording array having an elongated body and a plurality of arms provided at fixed angles relative to a center position of a recording field to enhance sound localization in a surround sound recording.

26 Claims, 9 Drawing Sheets

(56) References Cited

U.S. PATENT DOCUMENTS

| | | | | |
|---|---|---|---|---|
| 6,316,706 | B1 * | 11/2001 | Sammons | A47B 19/002 84/327 |
| 2002/0104945 | A1 * | 8/2002 | Uchimura | F16M 11/10 248/316.1 |
| 2008/0034869 | A1 * | 2/2008 | Heinz | G01H 3/125 73/572 |
| 2013/0094678 | A1 * | 4/2013 | Scholte | G01H 3/125 381/182 |

* cited by examiner

SURROUND SOUND RECORDING ARRAY

CROSS REFERENCE TO RELATED APPLICATION(S)

This application claims the benefit of priority under 35 U.S.C. §119(e) of U.S. Ser. No. 62/098,217, filed Dec. 30, 2014, the entire content of which is incorporated herein by reference.

BACKGROUND OF THE INVENTION

Field of the Invention

The invention relates generally to surround sound audio recording and, more specifically, to systems and methods for recording surround sound using a multichannel recording array.

Background Information

There are a number of existing "surround sound" systems which use digital or analogue equipment to record and reproduce sound. The goal of such systems is to recreate the sound environment. To recreate a sound environment, the surround sound system must be designed with an awareness of the human brain's ability to determine, within all three dimensions, where a given sound originates. The ear has two independent functions: first, to hear (auditory); second, to sense the motion of the listener or of an object in space identified by the listener (vestibular). The brain is able to recognize small differences in loudness and timing in sound waves as they reach both the left and right ears so as to exactly localize and follow a sound source in space. Realistic sound production must give the listener a sense of vestibular as well as auditory function, as the motion of the listener or object in space identified by the listener is necessary in the perception of reality.

In the past, recording in surround sound has been a cumbersome task. While there are microphone stands that support multiple microphones, they don't offer portability, nor do they offer a sonic advantage. Field recordists settle on small recording setups, usually consisting of a multi-capsule microphone, for portability. The problem is, there is no timing differences between the left and right channels of the array. A recordist may choose to use microphones spaced apart, utilizing timing differences to replicate a sound or space instead of relying solely on amplitude differences alone. The problem here is that the recordist must bring several microphone stands and cables along, and perhaps measuring equipment to place the microphones correctly within the array.

A typical surround sound environment consists of five to ten speakers placed around a room in several different configurations. In a movie theatre, for example, there may be three speakers behind the projection screen (left, center, and right), two speakers at the sides of the room (left-side and right-side) and two speakers at the rear of the room (left-surround and right surround). Each of these speakers is assigned its own specific channel. During the recording of the live sound sources for surround sound applications, the microphones are set up in a stationary positions at approximately the site at which the sound will be heard though the corresponding monitor speaker of the surround sound system.

Conventional techniques may utilize amplitude differences, and some even timing differences, but none of the techniques utilize frequency differences for recording surround sound. This leads to poor localization within the listening area. The human head filters out higher frequencies as they pass from one ear to another. None of these surround techniques take this into consideration, especially in conjunction with the other two localization factors. Thus, a need exists for a compact and low-cost multichannel array of microphones to record surround audio while taking all three factors into account.

SUMMARY OF THE INVENTION

The present invention is based on the finding that multiple microphones, accounting for typical surround sound speaker placement, may be placed at defined angles relative to a central position and, in some embodiments, separated by acoustical dampening baffles in order to record surround audio while taking into account amplitude, timing, and frequency differences.

Accordingly, in one aspect, the invention provides a multichannel sound recording array. The array includes an elongated body having an axis, a sleeve slidingly disposed on the body and having a first surface, a second surface, and an outer-circumferential surface, wherein the first surface comprises a plurality of slots extending away from the axis at fixed angles relative to a center position of a recording field, a plurality of arms, each having a first end hingedly attached to one of the plurality of slots of the sleeve and extending away from the axis through one of a plurality of slits disposed in the outer-circumferential surface of the sleeve, a plurality of support bars, each having a proximal end hingedly attached to the body and a distal end slidingly attached to one of the plurality of arms, and a plurality of microphones, each disposed on a second end of one of the plurality of arms. As such, when the sleeve is moved along the axis of the body in a direction towards the plurality of support bars, the arms extend away from the axis of the body, thereby extending the microphones at fixed angles relative to the center position of the recording field. Likewise, when the sleeve is moved along the axis of the body in a direction away from the plurality of support bars, the arms retract towards the axis of the body.

In another aspect, the invention provides a multichannel sound recording array. The array includes an elongated body having an axis, a sleeve slidingly disposed on the body and having a first surface, a second surface, and an outer-circumferential surface, wherein the first surface comprises a plurality of slots extending away from the axis at fixed angles relative to a center position of a recording field, a plurality of arms, each having a first end hingedly attached to the body, a plurality of support bars, each having a proximal end hingedly attached to one of the plurality of slots of the sleeve and extending away from the axis through one of a plurality of slits disposed in the outer-circumferential surface of the sleeve, and a distal end slidingly attached to one of the plurality of arms, and a plurality of microphones, each disposed on a second end of one of the plurality of arms. As such, when the sleeve is moved along the axis of the body in a direction towards the plurality of arms, the arms extend away from the axis of the body, thereby extending the microphones at fixed angles relative to the center position of the recording field. Likewise, when the sleeve is moved along the axis of the body in a direction away from the plurality of arms, the arms retract towards the axis of the body.

In yet another aspect, the invention provides a multichannel sound recording array. The array includes an elongated body having an axis, a first sleeve slidingly disposed on the body and having a first surface, a second surface, and an outer-circumferential surface, wherein the first surface comprises a plurality of first slots extending away from the axis at fixed angles relative to a center position of a recording field, a second sleeve slidingly disposed on the body and having a first surface, a second surface, and an outer-circumferential surface, wherein the second surface comprises a plurality of second slots extending away from the axis at the same fixed angles of the first sleeve, a plurality of arms, each having a first end hingedly attached to one of the plurality of slots of the first sleeve and extending away from the axis through one of a plurality of first slits disposed in the outer-circumferential surface of the first sleeve, a plurality of support bars, each having a proximal end hingedly attached to one of the plurality of slots of the second sleeve and extending away from the axis through one of a plurality of second slits disposed in the outer-circumferential surface of the second sleeve, and a distal end slidingly attached to one of the plurality of arms, and a plurality of microphones, each disposed on a second end of one of the plurality of arms. As such, when the first sleeve and the second sleeve are moved along the axis of the body in a direction towards each other, the arms extend away from the axis of the body, thereby extending the microphones at fixed angles relative to the center position of the recording field. Likewise, when the first sleeve and the second sleeve are moved along the axis of the body in a direction away from each other, the arms retract towards the axis of the body.

In yet another aspect, the invention provides a multichannel sound recording array. The array includes an elongated body having an axis, a first sleeve slidingly disposed on the body and having a first surface, a second surface, and an outer-circumferential surface, wherein the first surface comprises a plurality of first slots extending away from the axis at fixed angles relative to a center position of a recording field, a second sleeve slidingly disposed on the body and having a first surface, a second surface, and an outer-circumferential surface, wherein the second surface comprises a plurality of second slots extending away from the axis at the same fixed angles of the first sleeve, a plurality of arms, each having a first end hingedly attached to one of the plurality of slots of the first sleeve and extending away from the axis through one of a plurality of first slits disposed in the outer-circumferential surface of the first sleeve, and a plurality of microphones, each disposed on a second end of each of the first and second arms. Each corresponding pair of first and second arms are pivotally attached to one another such that when the first sleeve and the second sleeve are moved along the axis of the body in a direction towards each other, the first and second arms extend away from the axis of the body, thereby extending the microphones at fixed angles relative to the center position of the recording field. Likewise, when the first sleeve and the second sleeve are moved along the axis of the body in a direction away from each other, the first and second arms retract towards the axis of the body.

In various embodiments of each aspect of the invention, the multichannel sound recording array may include four arms, four support bars, and each of the sleeves may include four slots. Two of the slots may be provided at 30° relative to the center position of the recording field, and the other two slots are provided at 110° relative to the center position of the recording field. In various embodiments, two or more microphones may be disposed on each second end of each of the plurality of arms. In various embodiments, each arm may include a pair of sub-arms disposed in parallel and spaced apart from each other such that the distal end of each respective support is configured to slide between the sub-arms.

In various embodiments of each aspect of the invention, the multichannel sound recording array may also include a plurality of acoustically absorptive discs (AADs) disposed on each arm in close proximity to each of the plurality of microphones. In certain embodiments, the number of AADs disposed on each arm is determined by the following equation: $d=(x^2-x)/n$, where d=number of AADs, x=number of microphones in the array, and n=the number of arms in the array. The AADs may be formed from acoustic insulation.

In various embodiments of each aspect of the invention, the distal end of the elongated body of the multichannel sound recording array may be sized and shaped to attach to a stand. In various embodiments, one or more lock-pins disposed in each of the sleeves and configured to prevent the sleeves from sliding along the axis of the body. In various embodiments, the plurality of microphones is connected to a single cable.

DETAILED DESCRIPTION OF THE INVENTION

Figure 1A:
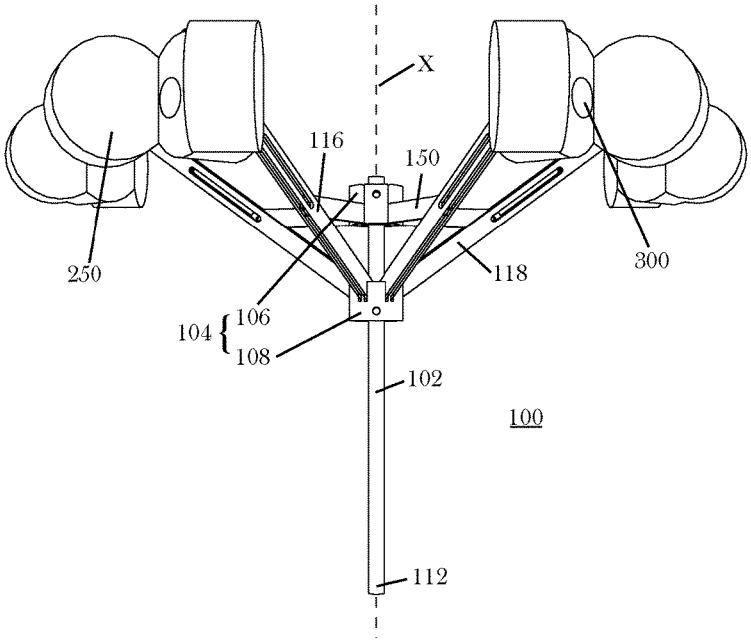
FIGS. 1A-1C are pictorial diagrams showing a front perspective view (FIG. 1A), rear perspective view (FIG. 1B), and top perspective view (FIG. 1C) of an exemplary embodiment of the multichannel sound recording array in its extended configuration.
Figure 1B:
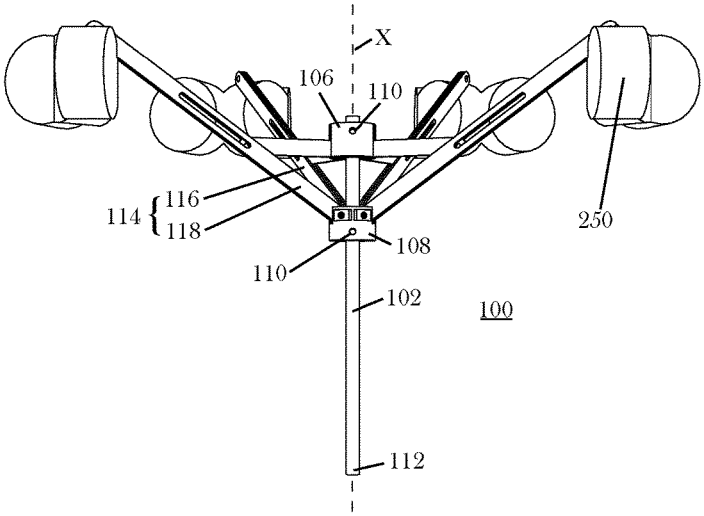
Figure 1C:
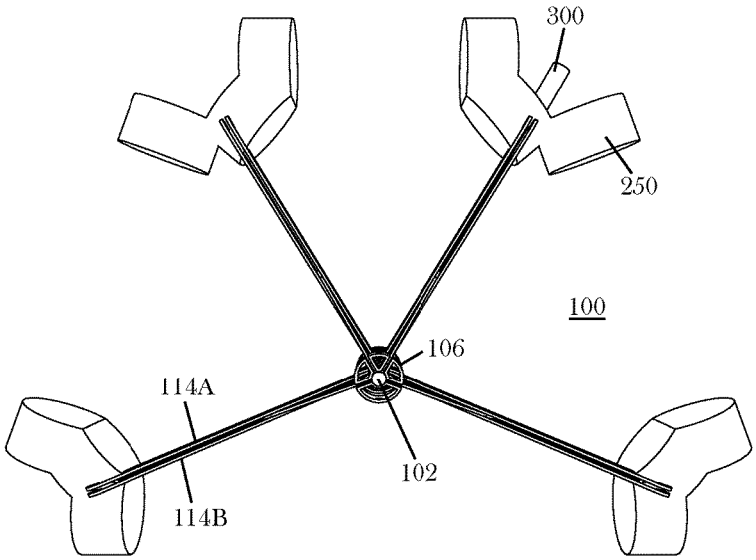

The present invention is based on the finding that multiple microphones, accounting for typical surround sound speaker placement, may be placed at defined angles relative to a central position to record surround audio while taking into account amplitude, timing, and frequency differences.

Before the present compositions and methods are described, it is to be understood that this invention is not limited to particular compositions, methods, and experimental conditions described, as such compositions, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

The term "comprising," which is used interchangeably with "including," "containing," or "characterized by," is inclusive or open-ended language and does not exclude additional, unrecited elements or method steps. The phrase "consisting of" excludes any element, step, or ingredient not specified in the claim. The phrase "consisting essentially of" limits the scope of a claim to the specified materials or steps and those that do not materially affect the basic and novel characteristics of the claimed invention. The present disclosure contemplates embodiments of the invention devices and methods corresponding to the scope of each of these phrases. Thus, a device or method comprising recited elements or steps contemplates particular embodiments in which the device or method consists essentially of or consists of those elements or steps.

As used herein, the term "recording field" refers to an environment outside of a recording studio within which an audio recording is recorded. The "center" (C) of a recording field refers to the direction a camera would be facing during the filming of a scene that corresponds to the surround sound being recorded.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

Current devices for recording surround sound do not provide strong localization within the surround field. The issues with some of these arrays include, but are not limited to:

Ambisonics & Mid-Side
- Shallow sweet spot in listening position
- No timing differences
- No frequency differences
- Can be confusing to decode
- Difficult file management/organization Spaced Omni
- No frequency differences
- Sounds are picked up from all directions and played back only in one direction from the speaker Spaced Cardioid
- Polar pattern is unchangeable
- Only on-axis sounds will be fully represented
- Sounds may be fully off-axis in multiple microphones, and never faithfully reproduced Dual capsule designs and pressure gradient capsules are not ideal for replicating the way humans hear The multichannel sound recording array described herein enables a user to record audio tracks that include frequency differences as well as amplitude and timing differences to achieve enhanced localization for recorded surround sound. The invention supports multiple microphones on a single stand, and offers a single point to collapse the whole array into a portable device. The new array also mirrors surround sound speaker placement standards, so that where a microphone receives a sound, it will be played back through the corresponding speaker in the correct location. While this in itself is not new, when combined with frequency differences, it allows for a sound wave to be replicated across an array of speakers in a more convincing way, thereby further enhancing localization.

For playback in a movie theater, this new array offers more realism in surround sound playback.

Thus, the multichannel sound recording array described herein achieves one or more of the following: increasing the size of the listening position sweet spot; enhancing localization; eliminating the need to encode/decode the recorded audio tracks; minimizing the amount of equipment used for recording audio; minimizing the setup time and effort required by a user; utilizing timing, amplitude and frequency differences simultaneously when recording audio; and utilizing Wave Field Synthesis principles to recreate recorded wave-fronts in the listening environment.

Aspects of the improved array include: single-point collapsibility; removable acoustic baffle system; expandable radius; precise microphone placement; and ability to use a single-connector cable.

Single Point Collapsibility

Many recording arrays use a plurality of microphone stands to achieve the desired positioning pattern. The disadvantages of this technique include the cumbersome size and weight of multiple microphone stands, and taking the time to measure out the position and angle of each microphone. There are some microphone arrays such as stereo and surround bars that allow for multiple microphones to be placed and positioned at once, but these are bulky, do not allow for the quickest setup, and do not fold down to a compact size.

The single-point collapsible surround array described herein minimizes the size of the folded array for portability and ease of use, while allowing the user to bring all microphones to calculated positions with a single movement during opening the array.

Figure 2A:
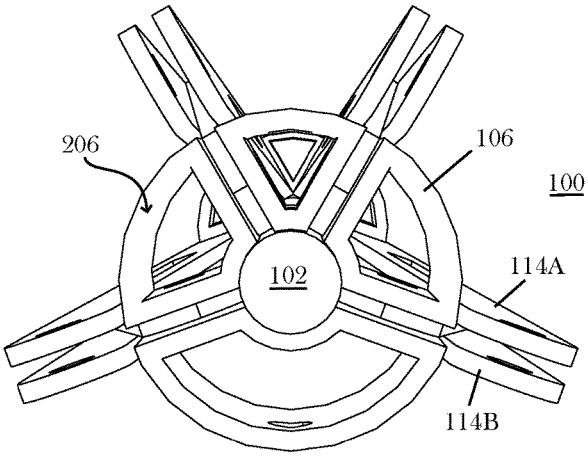
FIGS. 2A-2C are pictorial diagrams showing a top perspective view (FIG. 2A), front perspective view (FIG. 2B), and rear perspective view (FIG. 2C) of an exemplary embodiment of the multichannel sound recording array in its collapsed configuration.
Figure 2B:
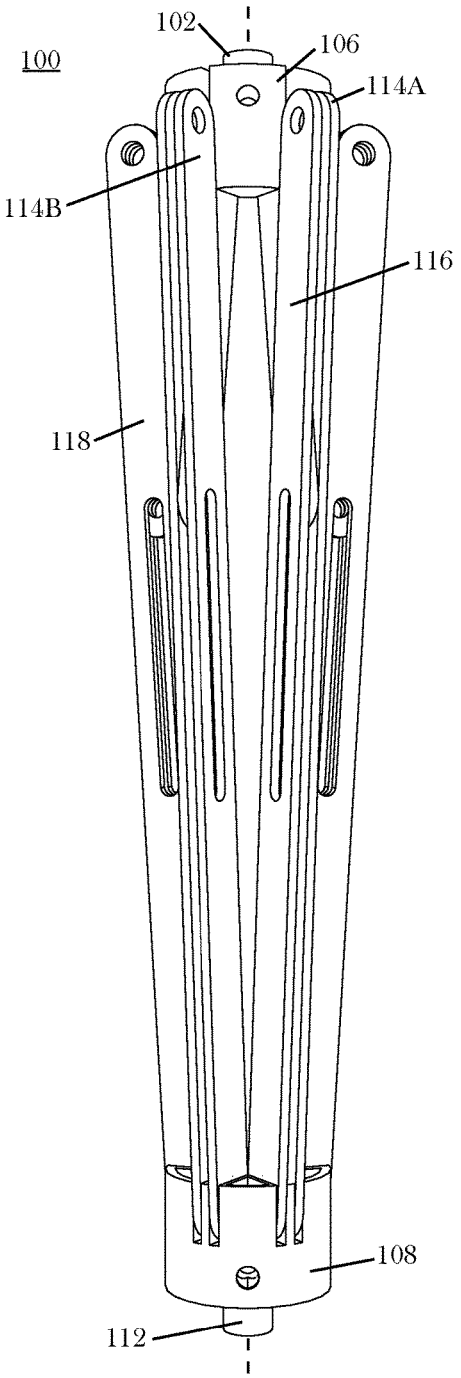
Figure 2C:
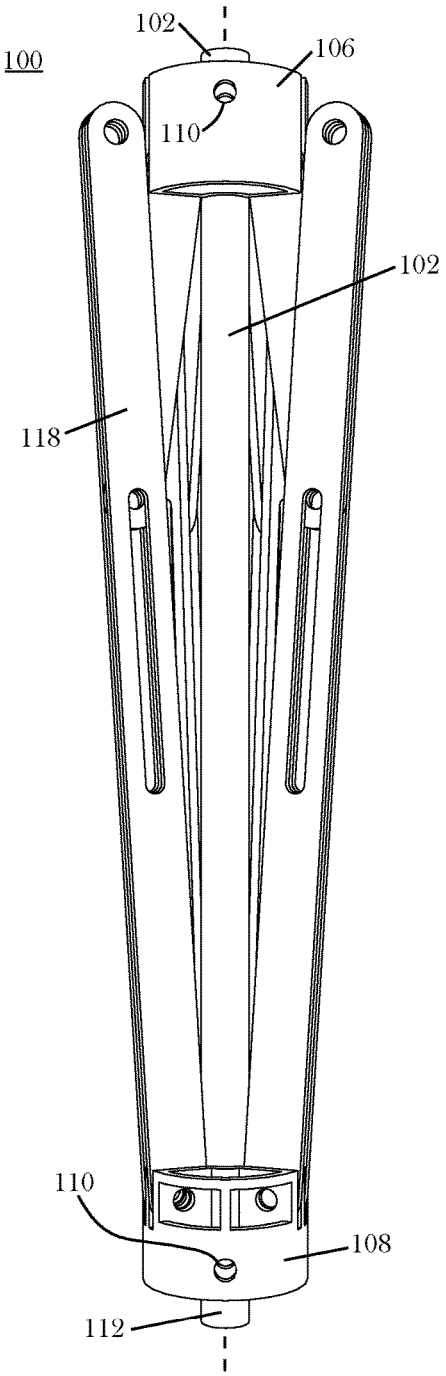

Accordingly, with reference to FIGS. 1A-2C, the invention provides a multichannel sound recording array 100. The array 100 includes an elongated body 102 having an axis X with one or more sleeves 104 or rings slidingly attached to the body 100. In various embodiments, the multichannel sound recording array 100 will include a top sleeve 106 and a bottom sleeve 108 (collectively referred to as sleeves 104) slidingly disposed on the elongated body 102, such that when the sleeves 104 slide toward one another along axis X, the multichannel sound recording array 100 extends to an opened position (FIGS. 1A-1C), and when the sleeves 104 slide away from one another along axis X, the multichannel sound recording array 100 collapses to a closed position (FIGS. 2A-2C). The sleeves 104 may individually be configured to remain stationary at a fixed position along body 102 by means of a locking tab or lock-pin 110, such that the sleeve 104 that is not so fixed in position may slide toward or away from the sleeve 104 that is fixed in position to open or close the multichannel sound recording array 100. In certain embodiments, a distal end 112 of the elongated body 102 may be sized and shaped to attach to a standard tripod (not shown) or microphone stand (not shown) using standard adapters known in the art.

Figure 3A:
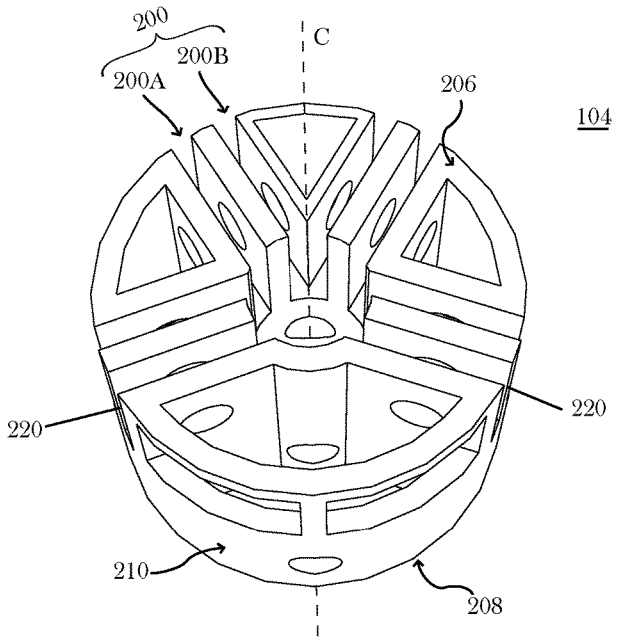
FIGS. 3A and 3B are pictorial diagrams showing a perspective view (FIG. 3A) and a top view (FIG. 3B) of a sleeve of an exemplary embodiment of the multichannel sound recording array.
Figure 3B:
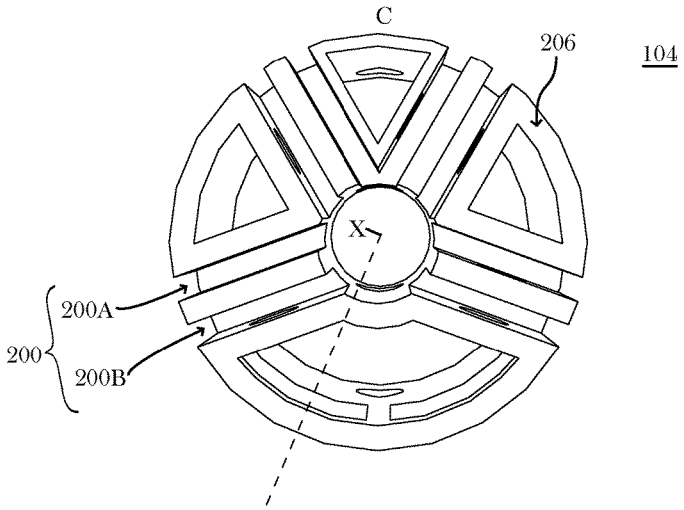
Figure 4A:
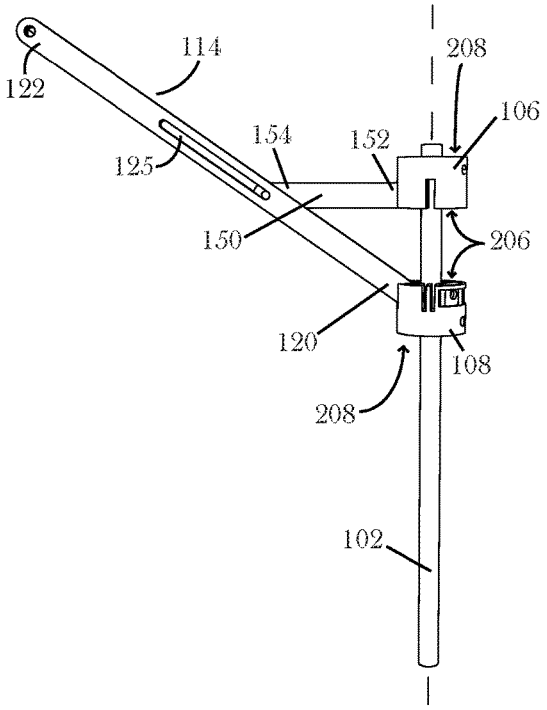
FIGS. 4A and 4B are pictorial diagrams showing a single boom arm of an exemplary embodiment of the multichannel sound recording array in the open position (FIG. 2A) and the closed position (FIG. 2B), which are achieved by sliding the sleeves toward or away from each other along the axis of the body.
Figure 4B:
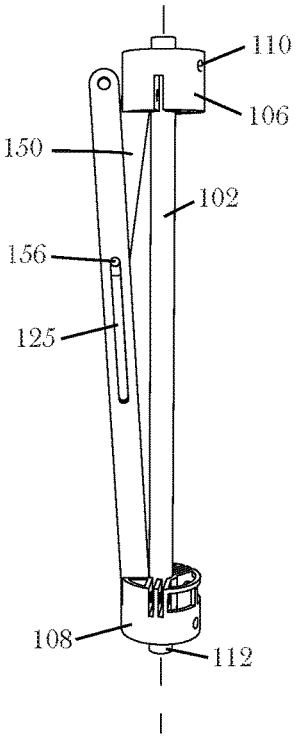

With reference now to FIGS. 3A and 3B, the sleeves 104 are formed to include a plurality of calculated slots 200 disposed therein at specific angles relative to axis X. The slots are provided in a single surface of the sleeves 104 and extend away from the axis X of the elongated body 102. Disposed in the outer surface 210 of the sleeves 104 is a plurality of slits 220 that correspond to each of the plurality of slots 200.

As shown in FIGS. 1A-2C, each of the plurality of calculated slots 200 are configured to hold a plurality of arms 114 of the multichannel sound recording array 100. In various embodiments, the sleeves may include a dual-slot and dual-slit configuration (i.e., two parallel slots 200A and 200B and two parallel slits 220A and 220B) per direction that are configured to correspond to a pair of sub-arms 114A and 114B (see FIG. 1C) disposed in parallel and spaced apart from each other for added strength and stability. In such a configuration, the distal ends 154 of support bars 150 slide between each pair of sub-arms 114A and 114B.

In various embodiments, the arms 114 may be formed from any rigid material, such as plastic, metal, carbon fiber, to ensure that the microphones of the array are rigidly held in place at the prescribed angles. In certain embodiments, the arms 114 are formed from metal that is approximately ⅛-inch thick.

In various embodiments, the slots 200 of sleeves 104 are configured to hold left front and right front arms 116 at about 30° from a center position C relative to the recording field, respectively, and left surround and right surround arms 118) at about 110° relative to the center position C of the recording field, respectively (FIGS. 1A and 3B). Thus, the front arms 116 and surround arms 118 (collectively referred to as arms 114) each have a first end 120 configured to hingedly attach to sleeve 104 and a second end 122 configured for pivotal attachment to one or more microphones 300 using a standard microphone attachment as is known in the art. In certain embodiments, the multichannel sound recording array 100 includes a single microphone 300 disposed on each second end 122 of each arm 114. In certain embodiments, the multichannel sound recording array 100 includes two microphones 300 disposed on each second end 122 of each arm 114.

In various embodiments, the multichannel sound recording array 100 may also include one or more support bars 150, each corresponding to a respective arm 114, and configured to further add to the stability of each arm. Each support bar 150 has a proximal end 152 that is configured to hingedly attach to the body 102, and a distal end 154 that is configured to slidingly engage a portion of arm 104. In certain embodiments, distal end 154 of support bar 150 will have a protrusion 156 disposed thereon and configured to engage a slot 125 formed in a portion of arm 114, such that protrusion 156 slides within slot 125 as the multichannel sound recording array 100 is opened and closed. Thus, in an exemplary embodiment wherein the multichannel sound recording array 100 is provided with a single sleeve 104, the sleeve 104 may have a first surface 206, a second surface 208, and an outer-circumferential surface 210, wherein the slots 200 are provided in the first surface 206. Each of the plurality of arms 114 extend away from axis X of the body 102 through one of the plurality of slits 220 disposed in the outer-circumferential surface 210 of the sleeve 104.

In an exemplary embodiment wherein the multichannel sound recording array 100 is provided with a top sleeve 106 and bottom sleeve 108, first ends 120 of arms 114 may collectively be hingedly attached to bottom sleeve 108, while proximal ends 152 of support bars 150 may collectively be hingedly attached to top sleeve 106. Each support bar 150 is therefore held at the same angle as its corresponding arm 114. Accordingly, the arms 114 pivot away from axis X on their respective hinged attachments to the upper sleeve 106 while the support bars 150 pivot away from axis X on their respective hinged attachments to the lower sleeve 108, as one or both sleeves 104 slide toward each other to open the multichannel sound recording array 100 (FIGS. 1A-1C and 4A). Likewise, the arms 114 pivot toward the axis X on their respective hinged attachments to the upper sleeve 106 while the support bars 150 pivot toward the axis X on their respective hinged attachments to the lower sleeve 108, as one or both sleeves 104 slide away from each other to close the multichannel sound recording array 100 (FIGS. 2A-2C and 4B). As such, when opened, each arm 114 and corresponding support bar 150 is outwardly held at desired positions at the specified angles relative to center C of the recording field.

Figure 5:
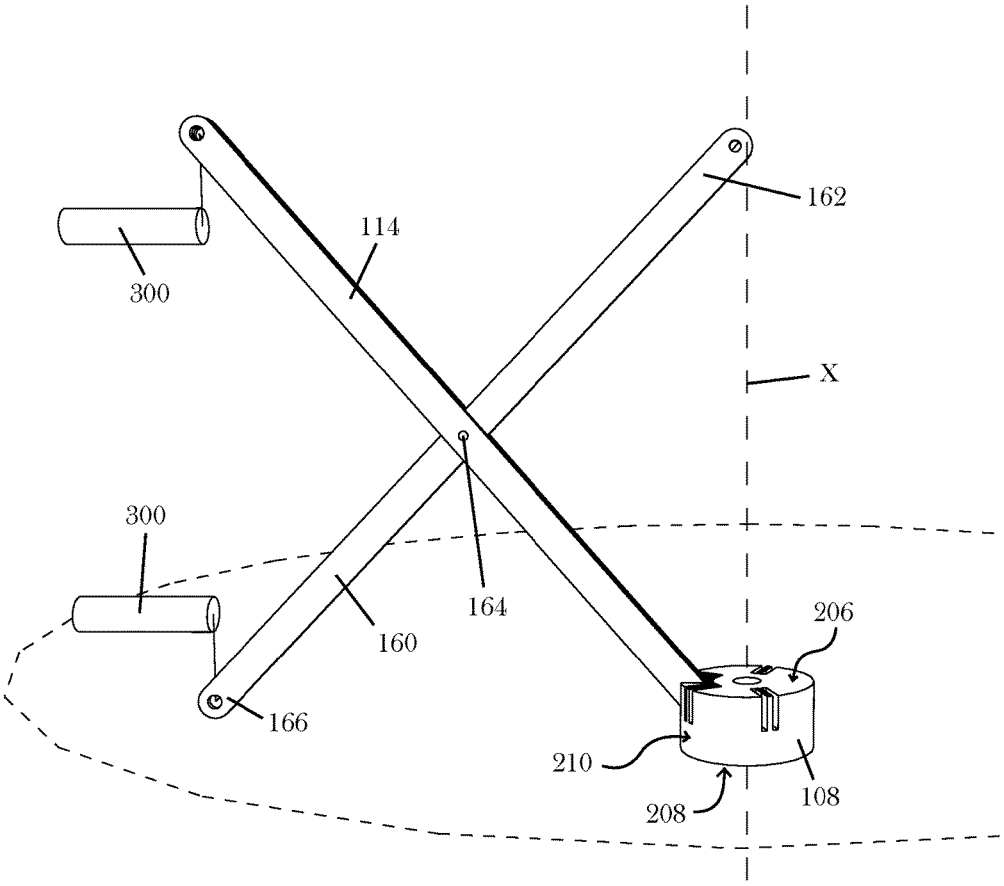
FIG. 5 is a pictorial diagram showing an exemplary embodiment of the multichannel sound recording array, which has two boom arms working together as support arms, thereby allowing two microphones to be placed on a vertical plane relative to each other.

With reference now to FIG. 5, in another exemplary embodiment, the multichannel sound recording array 100 may include first arms 114, as discussed above, and a plurality of second arms 160, instead of support arms 150, corresponding to each of the first arms 114. Each second arm 160 may have a proximal end 162 that is hingedly attached to top sleeve 106, and may be pivotally connected to the corresponding first arm 114 at a point 164 along the length of arm 114. Each distal end 166 of each second arm 160 is configured for pivotal attachment to one or more microphones 300 using a standard microphone attachment as is known in the art. Accordingly, the arms 114 pivot away from axis X on their respective hinged attachments to the upper sleeve 106 while the second arms 160 pivot away from axis X on their respective hinged attachments to the lower sleeve 108, as one or both sleeves 104 slide toward each other to open the multichannel sound recording array 100. Likewise, the arms 114 pivot toward the axis X on their respective hinged attachments to the upper sleeve 106 while the second arms 160 pivot toward the axis X on their respective hinged attachments to the lower sleeve 108, as one or both sleeves 104 slide away from each other to close the multichannel sound recording array 100. As such, when opened, each arm 114 and corresponding second arm 160 is outwardly held at desired positions at the specified angles relative to center C.

Removable Baffle System

Most human beings are able to localize sounds based on three differences between their ears: amplitude, timing, and frequency. However, such localization of recorded sound is often difficult to reproduce. Accordingly, various embodiments of the present invention further include a plurality of removable baffles disposed in close proximity to a respective microphone of the multichannel sound recording array 100, and configured to enable a person to localize sounds recorded using the multichannel sound recording array 100. In various embodiments, a pair of small acoustically absorptive discs (AADs) provided between each pair of microphones, enables higher frequencies to be absorbed more than lower frequencies. In one embodiment, the AAD is made from 2-inch thick Owens Corning 703 Acoustic Insulation. Table 1 shows the absorption coefficients of 2-inch thick Owens Corning 703 mounted on a flat surface.

TABLE 1

| 125 HZ | 250 HZ | 500 HZ | 1000 HZ | 2000 HZ | 4000 HZ | NRC |
|---|---|---|---|---|---|---|
| 0.17 | 0.86 | 1.14 | 1.07 | 1.02 | 0.98 | 1.00 |

However, any material that isolates the microphones by way of frequency differences may be used as an AAD for the multichannel sound recording array 100. Without being bound by theory, each of the pairs of AADs creates an acoustic shadow which has a larger effective area of coverage (EAC) than a large single AAD would absorb, if placed in the center of the microphones of the multichannel sound recording array 100. Thus, splitting the AAD into corresponding pairs and placing the two smaller AADs closer to the microphones of the multichannel sound recording array 100 dramatically cuts down material, thereby improving portability.

Figure 6A:
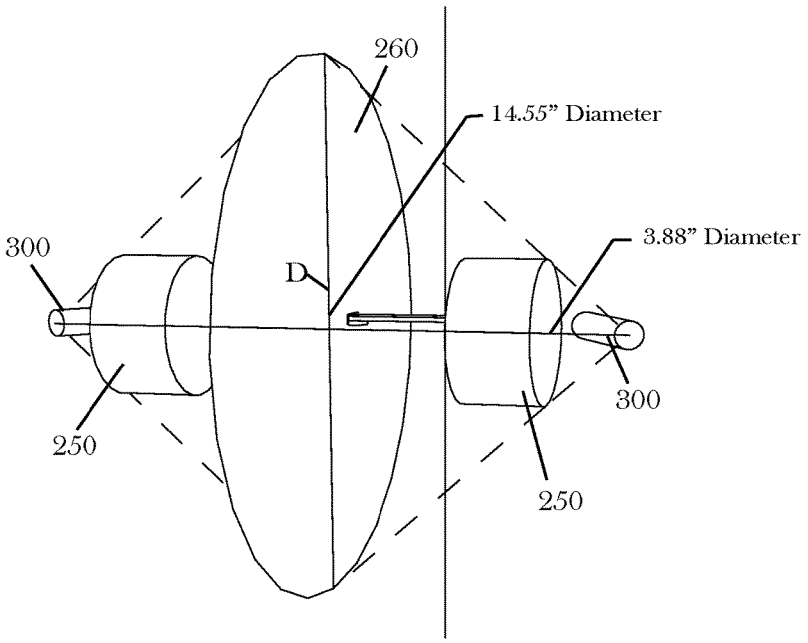
FIGS. 6A and 6B are pictorial diagrams showing a perspective view (FIG. 6A) and a front view (FIG. 6B) of the casting shadow of AADs when used in conjunction with an exemplary embodiment of the multichannel sound recording array.
Figure 6B:
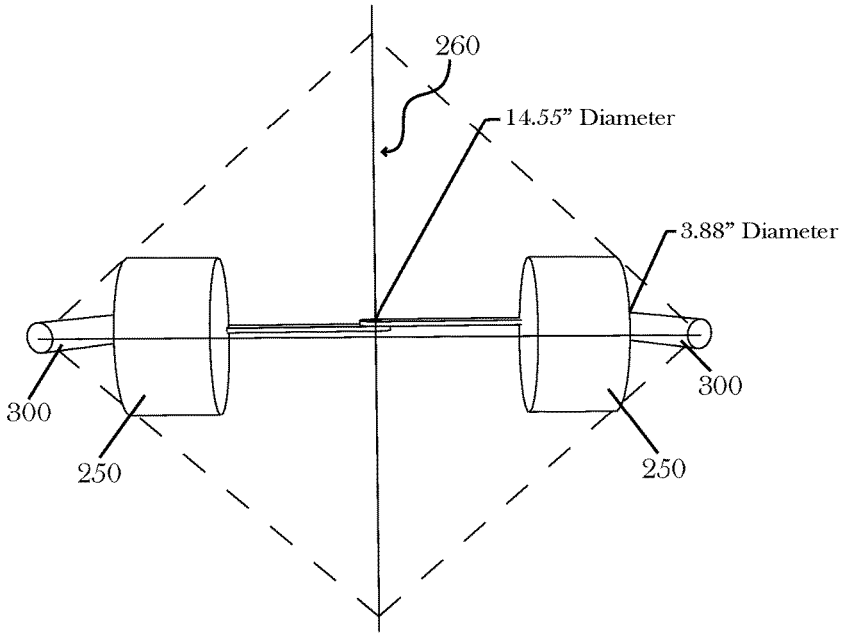

With reference now to FIGS. 6A and 6B, there is shown an exemplary embodiment of a pair of microphones 300 of the multichannel sound recording array 100, with a pair of AADs 250, and the resulting EAC 260 created by the acoustic shadow of the AADs 250. The diameter of the AAD 250 may be calculated by a given ratio of distance from the AAD to its respective microphone, thereby creating an EAC 260 of a preferred diameter D. As shown, the ratio 1:1.94 is utilized in this exemplary embodiment, meaning the diameter D of the AADs 250 are equal to the distance from the center of the AAD 250 to the microphone 300 multiplied by 1.94. In this example of a 1:1.94 ratio, an AAD 250 placed two inches away from the microphone 300 would be 3.88 inches in diameter. The following equation is used to calculate the diameter of the EAC 260.

$$D = \frac{y}{2} \cdot r$$

Where, D=diameter of EAC; y=distance between two microphones; and r=AAD size ratio.

Accordingly, in this exemplary embodiment, two AADs 250 are disposed directly in between the microphone pair, one is placed two inches away from the left microphone 300, and one is placed two inches away from the right microphone 300, as shown in FIG. 6B. In various embodiments, the total number of AADs 250 that are used in the multichannel sound recording array 100 is determined according to the following equation:

$$d=x^2-x$$

where, d=number of AADs; and x=number of microphones in an array. As such, the number of AADs 250 used on each arm 114 of the multichannel sound recording array 100 would be d/n, where n=the number of arms 114 in the multichannel sound recording array 100. In other words, the number of AADs 250 disposed on each arm 114 of the array 100 may be determined by the following equation: $d=(x^2-x)/n$, where d=number of AADs, x=number of microphones in the array, and n=the number of arms in the array.

Figure 7A:
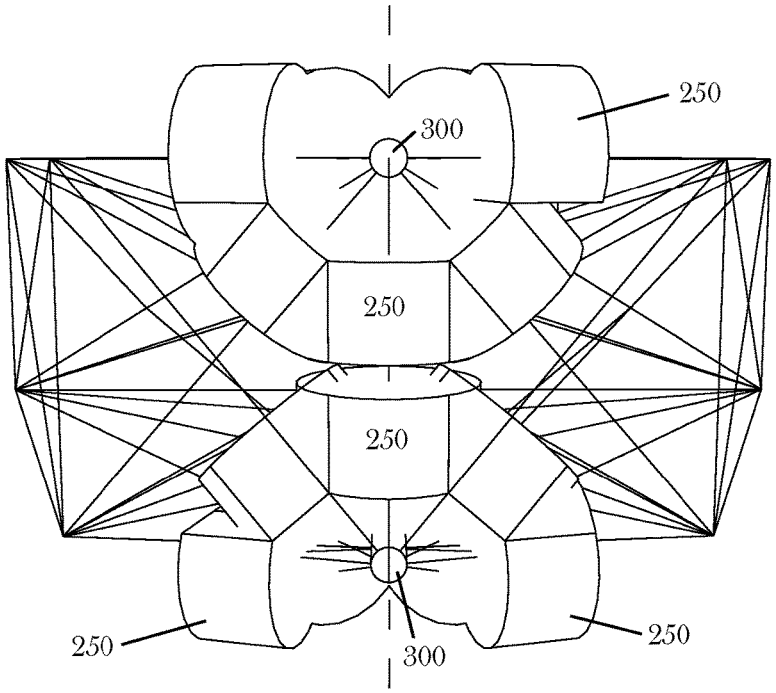
FIGS. 7A and 7B are pictorial diagrams showing a front view (FIG. 7A) and a side view (FIG. 7B) of top and bottom center AAD configurations for an exemplary embodiment of a 10-point multichannel sound recording array.
Figure 7B:
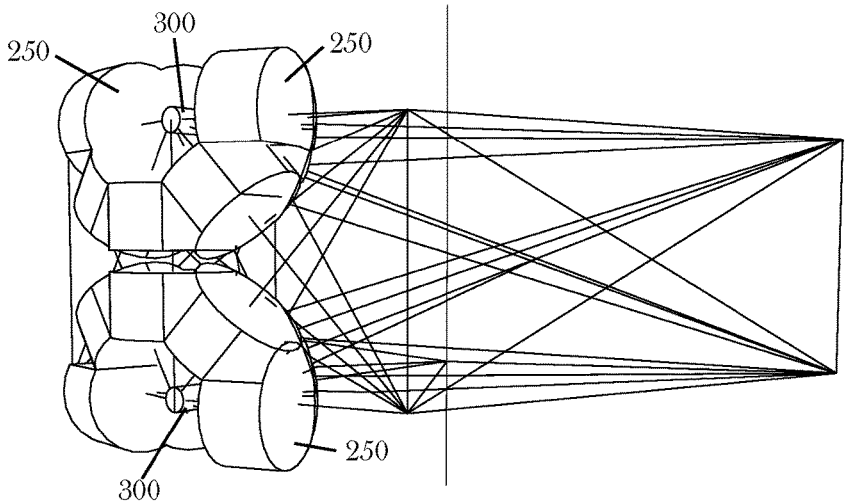

In various embodiments involving higher numbers of microphones 300, the AADs 250 covering a single microphone 300 may begin to intersect. Any portion of an AAD 250 may be omitted if an overlapping portion of another AAD 250 disposed in close proximity thereto, is closer to the microphone 300. An exemplary embodiment of top and bottom center AADs (shown in white) from a 10-point array is shown in FIGS. 7A and 7B.

Expandable Radius

In various embodiments, the arms 114, support bars 150, and/or second arms 160 of multichannel sound recording array 100 may be formed from a multitude of segmented sections, thereby enabling each of the arms 114, support bars 150, and/or second arms 160 to extend in a linear direction away from the axis X of the body. Such telescopic arms 114, support bars 150, and/or second arms 160 may thereby provide an expandable and variable radius of microphone 300 distance relative to the axis X of the body. The variable distance between the microphones 300 alters the time it takes for a sound to travel through the multichannel sound recording array 100, thereby creating different sonic characteristics in the recorded audio. As the ratio of the microphone distance to the AAD diameter size is fixed, the EAC 260 adjusts with the expanding radius of the multichannel sound recording array 100. Therefore, a variable distance between the AADs 250 alters the size of the EAC 260 relative to the ratio used to calculate the AAD 250 size. Such a configuration provides the flexibility to alter microphone 300 distance while retaining the sonic characteristics of the AADs 250.

Precise Microphone Placement

Figure 8:
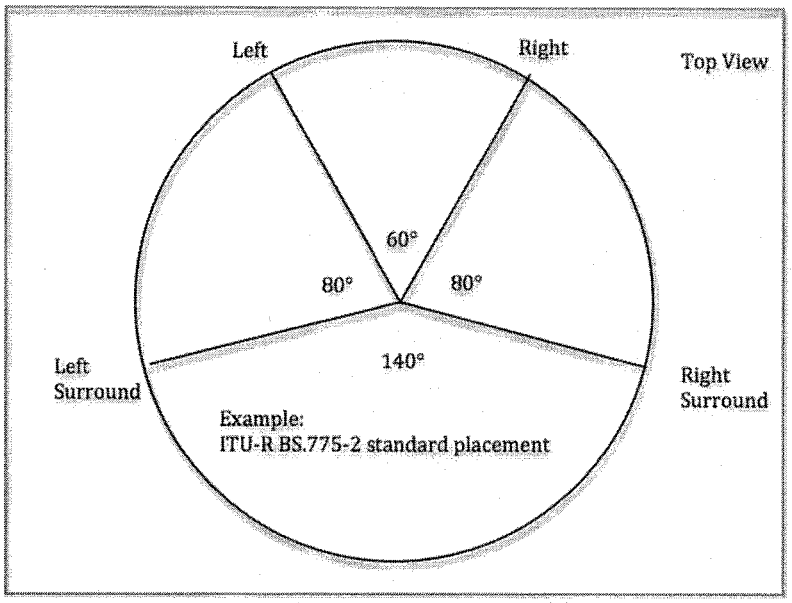
FIG. 8 is a graphical diagram showing ITU-R BS.775-2 standard placement.

The placement of the microphones 300 in any configuration of the multichannel sound recording array 100 should match the speaker placement of the system intended for playback. In various embodiments, a four-channel array composed of front left, front right, left surround, and right surround microphones 300 is intended for playback on a system following the ITU-R BS.775-2 speaker placement standard for 5.1 surround (FIG. 8).

Other examples of playback systems by which the multichannel sound recording array 100 may be designed to record include, but are not limited to, the ITU-R BS.2159-5 standard placements of multichannel speaker arrays, and Barco's Auro 3D 11.1 surround system.

In various embodiments, microphones corresponding to one or more speaker positions of the playback system may be omitted when using the multichannel sound recording array 100. For example, a four-channel array that includes front left, front right, left surround, and right surround microphones 300 may be used to record audio that is intended for playback on a system following the ITU-R BS.775-2 speaker placement standard for 5.1 surround (FIG. 8), but does not include a dedicated microphone corresponding to the center channel speaker position as part of the multichannel sound recording array 100.

Single Connector Cable

Figure 9:
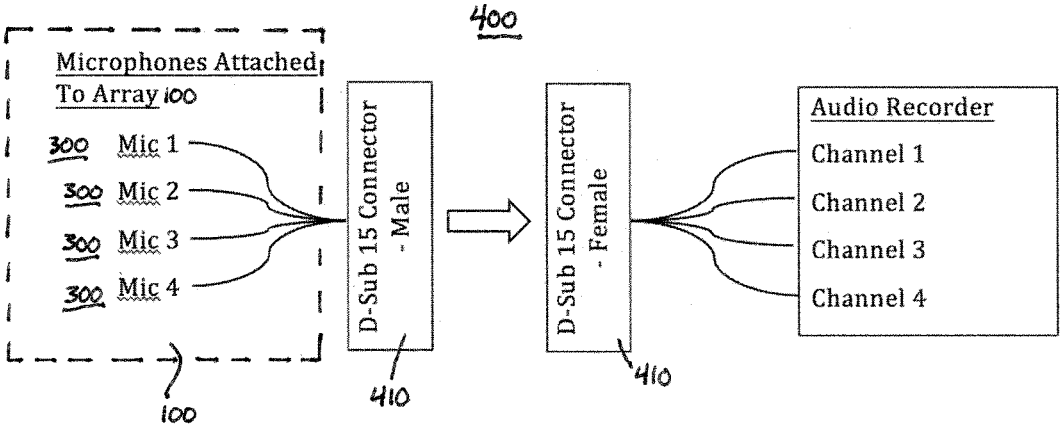
FIG. 9 is a schematic diagram showing a 4-channel snake connector used in conjunction with an exemplary embodiment of the multichannel sound recording array.

With reference now to FIG. 9, for increased portability, the multichannel sound recording array 100 may further include a multichannel cable 400, which is configured to connect each of the microphones 300 of the multichannel sound recording array 100 to one or more recording device(s) via, for example, XLR connectors. The multichannel cable 400 may be split into two or more portions, with the first being disposed at or near the elongated body 102 of the multichannel sound recording array 100. The first portion may include a D-Sub pin connector or similar connector 410 configured to allow the first portion of the multichannel cable 400 to be permanently attached to the multichannel sound recording array 100, with the second portion of the multichannel cable 400 being configured for attachment to the one or more recording device(s). In certain embodiments, the multichannel cable 400 may include a third (or greater) portion, which may serve as an extension cable to permit the one or more recording device(s) to be located at a greater distance from the multichannel sound recording array 100 than if the multichannel cable 400 were provided with only two portions. In a non-limiting exemplary embodiment, the multichannel cable 400 for a 4-channel array would need a D-Sub pin connector with at least 12 pins, because each microphone 300 requires three pins. Such a configuration decreases setup time and effort, while increasing portability and ease of use.

Although the invention has been described with reference to the above example, it will be understood that modifications and variations are encompassed within the spirit and scope of the invention. Accordingly, the invention is limited only by the following claims.

What is claimed is:

1. A multichannel sound recording array comprising:

(a) an elongated body having an axis;

(b) a sleeve slidingly disposed on the body and having a first surface, a second surface, and an outer-circumferential surface, wherein the first surface comprises a plurality of slots extending away from the axis at fixed angles relative to a center position of a recording field;

(c) a plurality of arms, each having a first end hingedly attached to one of the plurality of slots of the sleeve and extending away from the axis through one of a plurality of slits disposed in the outer-circumferential surface of the sleeve;

(d) a plurality of support bars, each having a proximal end hingedly attached to the body and a distal end slidingly attached to one of the plurality of arms; and (e) a plurality of microphones, each disposed on a second end of one of the plurality of arms, wherein when the sleeve is moved along the axis of the body in a direction towards the proximal ends of the plurality of support bars, the arms extend away from the axis of the body, thereby extending the microphones at fixed angles relative to the center position of the recording field, and wherein when the sleeve is moved along the axis of the body in a direction away from the distal ends of the plurality of supports, the arms retract towards the axis of the body.

2. The multichannel sound recording array of claim 1, wherein the multichannel sound recording array comprises four arms, four support bars, and the sleeve includes four slots.

3. The multichannel sound recording array of claim 2, wherein two of the slots are provided at 30° relative to the center position of the recording field, and the other two slots are provided at 110° relative to the center position of the recording field.

4. The multichannel sound recording array of claim 1, wherein two microphones are disposed on each second end of each of the plurality of arms.

5. The multichannel sound recording array of claim 1, further comprising a plurality of acoustically absorptive discs (AADs) disposed on each arm in close proximity to each of the plurality of microphones.

6. The multichannel sound recording array of claim 5, wherein the number of AADs disposed on each arm is determined by the following equation: $d=(x^2-x)/n$, where d=number of AADs, x=number of microphones in the array, and n=the number of arms in the array.

7. The multichannel sound recording array of claim 5, wherein the AADs are formed from acoustic insulation.

8. The multichannel sound recording array of claim 1, wherein each arm comprises a pair of sub-arms disposed in parallel and spaced apart from each other such that the distal end of each respective support is configured to slide between the sub-arms.

9. The multichannel sound recording array of claim 1, further comprising a lock-pin disposed in the sleeve and configured to prevent the sleeve from sliding along the axis of the body.

10. A multichannel sound recording array comprising:

(a) an elongated body having an axis;

(b) a first sleeve slidingly disposed on the body and having a first surface, a second surface, and an outer-circumferential surface, wherein the first surface comprises a plurality of first slots extending away from the axis at fixed angles relative to a center position of a recording field;

(c) a second sleeve slidingly disposed on the body and having a first surface, a second surface, and an outer-circumferential surface, wherein the second surface comprises a plurality of second slots extending away from the axis at the same fixed angles of the first sleeve;

(d) a plurality of arms, each having a first end hingedly attached to one of the plurality of slots of the first sleeve and extending away from the axis through one of a plurality of first slits disposed in the outer-circumferential surface of the first sleeve;

(e) a plurality of support bars, each having a proximal end hingedly attached to one of the plurality of slots of the second sleeve and extending away from the axis through one of a plurality of second slits disposed in the outer-circumferential surface of the second sleeve, and a distal end slidingly attached to one of the plurality of arms; and (f) a plurality of microphones, each disposed on a second end of one of the plurality of arms, wherein when the first sleeve and the second sleeve are moved along the axis of the body in a direction towards each other, the arms extend away from the axis of the body, thereby extending the microphones at fixed angles relative to the center position of the recording field, and wherein when the first sleeve and the second sleeve are moved along the axis of the body in a direction away from each other, the arms retract towards the axis of the body.

11. The multichannel sound recording array of claim 10, wherein the multichannel sound recording array comprises four arms, four support bars, and each of the first and second sleeves includes four slots.

12. The multichannel sound recording array of claim 11, wherein two of the slots of each sleeve are provided at 30° relative to the center position of the recording field, and the other two slots of each sleeve are provided at 110° relative to the center position of the recording field.

13. The multichannel sound recording array of claim 10, wherein two microphones are disposed on each second end of each of the plurality of arms.

14. The multichannel sound recording array of claim 10, further comprising a plurality of acoustically absorptive discs (AADs) disposed on each arm in close proximity to each of the plurality of microphones.

15. The multichannel sound recording array of claim 14, wherein the number of AADs disposed on each arm is determined by the following equation: $d=(x^2-x)/n$, where d=number of AADs, x=number of microphones in the array, and n=the number of arms in the array.

16. The multichannel sound recording array of claim 14, wherein the AADs are formed from acoustic insulation.

17. The multichannel sound recording array of claim 10, wherein each arm comprises a pair of sub-arms disposed in parallel and spaced apart from each other such that the distal end of each respective support is configured to slide between the sub-arms.

18. The multichannel sound recording array of claim 10, further comprising a first lock-pin disposed in the first sleeve and configured to prevent the first sleeve from sliding along the axis of the body, and a second lock-pin disposed in the second sleeve and configured to prevent the second sleeve from sliding along the axis of the body.

19. A multichannel sound recording array comprising:

(a) an elongated body having an axis;

(b) a first sleeve slidingly disposed on the body and having a first surface, a second surface, and an outer-circumferential surface, wherein the first surface comprises a plurality of slots extending away from the axis at fixed angles relative to a center position of a recording field;

(c) a second sleeve slidingly disposed on the body and having a first surface, a second surface, and an outer-circumferential surface, wherein the second surface comprises a plurality of slots extending away from the axis at the same fixed angles as the slots of the first sleeve;

(d) a plurality of first arms, each having a first end hingedly attached to one of the plurality of slots of the first sleeve and extending away from the axis through one of a plurality of first slits disposed in the outer-circumferential surface of the first sleeve;

(e) a plurality of second arms, each having a first end pivotally attached to one of the plurality of slots of the second sleeve and extending away from the axis through one of a plurality of second slits disposed in the outer-circumferential surface of the second sleeve; and (f) a plurality of microphones, each disposed on a second end of each of the first and second arms, wherein each corresponding pair of first and second arms are pivotally attached to one another such that when the first sleeve and the second sleeve are moved along the axis of the body in a direction towards each other, the first and second arms extend away from the axis of the body, thereby extending the microphones at fixed angles relative to the center position of the recording field, and wherein when the first sleeve and the second sleeve are moved along the axis of the body in a direction away from each other, the first and second arms retract towards the axis of the body.

20. The multichannel sound recording array of claim 19, wherein the multichannel sound recording array comprises four first arms, four second arms, and each of the first and second sleeves includes four slots.

21. The multichannel sound recording array of claim 20, wherein two of the slots of each sleeve are provided at 30° relative to the center position of the recording field, and the other two slots of each sleeve are provided at 110° relative to the center position of the recording field.

22. The multichannel sound recording array of claim 19, wherein two microphones are disposed on each second end of each of the plurality of first and second arms.

23. The multichannel sound recording array of claim 19, further comprising a plurality of acoustically absorptive discs (AADs) disposed on each arm in close proximity to each of the plurality of microphones.

24. The multichannel sound recording array of claim 23, wherein the number of AADs disposed on each arm is determined by the following equation: $d=(x^2-x)/n$, where d=number of AADs, x=number of microphones in the array, and n=the number of arms in the array.

25. The multichannel sound recording array of claim 23, wherein the AADs are formed from acoustic insulation.

26. The multichannel sound recording array of claim 19, further comprising a first lock-pin disposed in the first sleeve and configured to prevent the first sleeve from sliding along the axis of the body, and a second lock-pin disposed in the second sleeve and configured to prevent the second sleeve from sliding along the axis of the body.

* * * * *